US007075400B2

(12) United States Patent
Lerchenmueller et al.

(10) Patent No.: US 7,075,400 B2
(45) Date of Patent: Jul. 11, 2006

(54) ELECTRICAL CONTACTING OF THIN ENAMELED WIRES OF SECONDARY WINDINGS OF IGNITION COILS

(75) Inventors: Klaus Lerchenmueller, Immenstadt (DE); Konstantin Lindenthal, Blaichach (DE); Thomas Breckle, Bihlerdorf (DE); Juergen Raedler, Sonthofen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/534,371

(22) PCT Filed: Jul. 3, 2003

(86) PCT No.: PCT/DE03/02234

§ 371 (c)(1),
(2), (4) Date: Dec. 28, 2005

(87) PCT Pub. No.: WO2004/042748

PCT Pub. Date: May 21, 2004

(65) Prior Publication Data

US 2006/0097834 A1 May 11, 2006

(30) Foreign Application Priority Data

Nov. 7, 2002 (DE) ..... 102 51 840

(51) Int. Cl.
*H01F 27/29* (2006.01)

(52) U.S. Cl. ..... 336/192

(58) Field of Classification Search ..... 336/90–96, 336/107, 192, 198; 123/634, 635
See application file for complete search history.

(56) References Cited

U.S. PATENT DOCUMENTS

| | | | | |
|---|---|---|---|---|
| 6,094,121 | A | 7/2000 | Sakamaki et al. | |
| 6,522,232 | B1 * | 2/2003 | Paul et al. | 336/96 |
| 6,724,289 | B1 * | 4/2004 | Moga et al. | 336/90 |
| 6,747,540 | B1 * | 6/2004 | Nakase et al. | 336/192 |
| 6,836,203 | B1 * | 12/2004 | Wada | 336/198 |

FOREIGN PATENT DOCUMENTS

| | | |
|---|---|---|
| DE | 38 30 763 | 3/1990 |
| EP | 0 837 481 | 4/1998 |

* cited by examiner

*Primary Examiner*—Tuyen T Nguyen
(74) *Attorney, Agent, or Firm*—Kenyon & Kenyon LLP

(57) ABSTRACT

An electrical connection set-up for manufacturing an ignition coil is provided, e.g., for connecting thin enameled wires in ignition coils. In this regard, on the side of the high-voltage outlet, a contacting sleeve is provided which is installed by being lifted over a corresponding secondary winding without making contact and which then snaps into place due to the spring-like form or mounting, while elements provided on the contacting sleeve break through an insulating layer surrounding the secondary winding, thus establishing the electrical connection without the use of thermal methods.

8 Claims, 3 Drawing Sheets

ELECTRICAL CONTACTING OF THIN ENAMELED WIRES OF SECONDARY WINDINGS OF IGNITION COILS

FIELD OF THE INVENTION

The present invention relates to an electrical connection set-up for manufacturing an ignition coil, particularly a rod-type ignition coil having an ignition coil rod with a high-voltage outlet.

BACKGROUND INFORMATION

Ignition coils may produce a high-voltage spark, which jump between the electrodes of the spark plug set up at the ignition coil, thus igniting the air-gasoline mixture of an internal combustion engine, for example. This spark plug may be supplied with high voltage from an ignition coil. A primary winding and a corresponding secondary winding may be provided within the ignition coil. At one end, the primary winding may be connected to an ignition switch, while its other end may be connected to a so-called contact breaker.

The secondary winding, that is, the winding responsible for generating the ignition spark, may be connected in the interior of the ignition coil to the one end of the primary winding, so that it is grounded. The other end of the secondary winding may be connected to the high-voltage outlet, which in turn may be either connected to an ignition cable leading to the spark plug, or at which the spark plug is set up directly.

The secondary winding itself may be made of a thin wire coated with a suitable layer of enamel so as to avoid the contacting of the individual wires when wrapping a specific support part or coil shell. After the secondary windings have been wound onto a shell, the ends of the respective wires are contacted. Thermal contacting methods such as soldering or welding, for example, may be used for this purpose.

Different work processes may be required, such as, for example, with regard to contacting the primary and secondary windings. This may entail higher installation costs, multiple assembly steps and also a certain number of connecting parts required to make an appropriate electrical connection.

Furthermore, in a tight installation space, it may be difficult to bring about an appropriate contacting using conventional thermal methods.

SUMMARY OF THE INVENTION

The present invention may provide a connection set-up between an ignition coil rod of an ignition coil and a secondary or primary winding which is inexpensive and readily implemented.

According to an exemplary embodiment of the present invention, the conventional thermal contacting method may be replaced by providing additional contacting elements that break through the enamel-coated wire of the secondary winding during installation, thus bringing about an appropriate contacting.

In particular, it may be seen as desirable for the electrical connection set-up for producing an ignition coil, that the contacting be integrated into already existing components, and may be reliably produced using simple processes.

Compared to the conventional method, a "cold" contacting method proposed here may involve no additional installation costs. In addition, the set-up of the present invention may reduce the number of assembly steps and the number of connecting parts.

According to an exemplary embodiment of the present invention, the implementation of the contacting does not require optimization of the installation space. Thus, it may not be necessary to reserve a free space in the area of contacting, e.g. for electrode holders, soldering irons or the like.

Simply by sliding a contact sleeve onto the coil shell configured as a secondary winding, this contacting body may be slid directly onto the coil shell without shifting the installed secondary winding. This may be achieved by the feature that the contact sleeve is slit lengthwise and may thus be opened up as a spring.

This contact sleeve may feature contact clips on its outer surface, which, after the contact sleeve has been slid onto the coil shell, contact the wire of the secondary winding due to their spring-like form in that the contact clip of the contact sleeve breaks through the insulation, for example, of an enamel coating of the wires of the secondary winding.

The contact sleeve may be guided over the coil shell until it strikes against a stop formed on an ignition coil rod. To prevent damaging or shifting the secondary wire, the diameter of the contact sleeve may be larger or at least equal to the diameter of the secondary shell and twice as large as the diameter of the wire. As soon as the contact sleeve is positioned in a very straightforward manner in the contacting area of the ignition coil rod, it may be installed in the ignition coil housing with the high-voltage outlet. By insertion into a cup-shaped formation, the contact clips are pressed onto the winding of the secondary winding, thus breaking through the insulating layer of the wire and establishing a permanent electrical contact. The free end of the winding of the secondary wire may be wound around a pin-like formation at the end of the ignition coil rod. This pin is then inserted into the high-voltage outlet. This may prevent failures of the ignition coil due to superelevations of the field at the end of the wire.

A space-saving alternative may provide for rupture joints on the pin-like formation of the ignition coil rod so that, when the assembly is installed into the ignition coil housing, the pin on the side of the high-voltage outlet breaks, and specifically inwardly so that contact is ensured in spite of the break.

DETAILED DESCRIPTION

Figure 1:
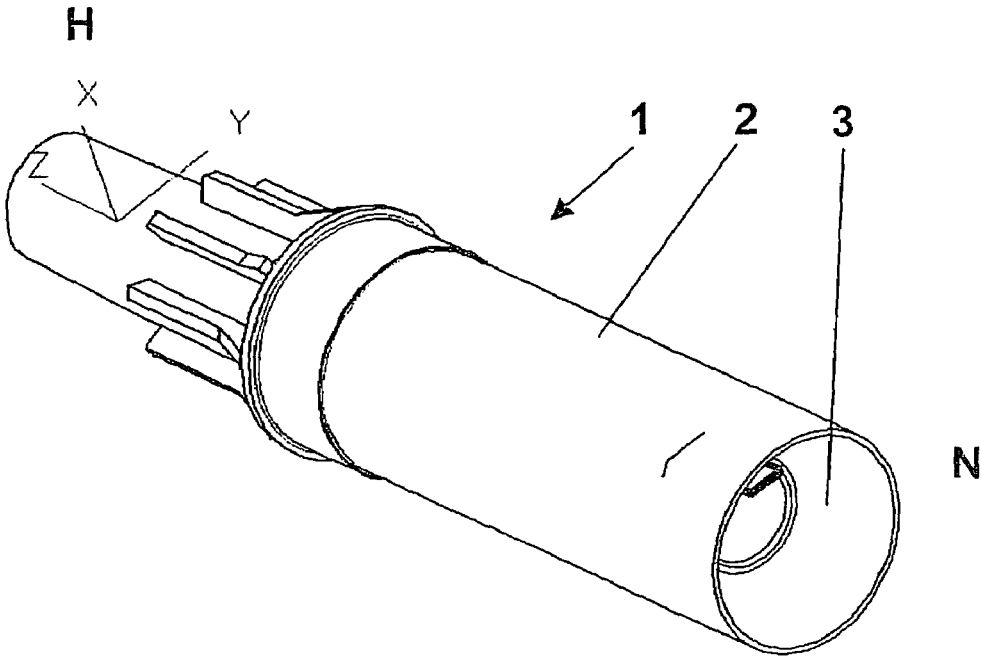
FIG. 1 shows a perspective view of an ignition coil having one side for the high-voltage outlet and another side for the low-voltage outlet.

FIG. 1 shows a perspective view of an ignition coil 1. Ignition coil 1 includes an ignition coil housing 2 and an ignition coil rod 3 located in ignition coil housing 2. In addition, ignition coil 1 features a side for a high-voltage outlet H and a side for the low-voltage outlet N. The side of low-voltage outlet N is provided to establish contact with a power supply not detailed in the drawing, while the side of high-voltage outlet H is provided for connecting to an ignition cable or a spark plug not detailed in the drawing.

Figure 2:
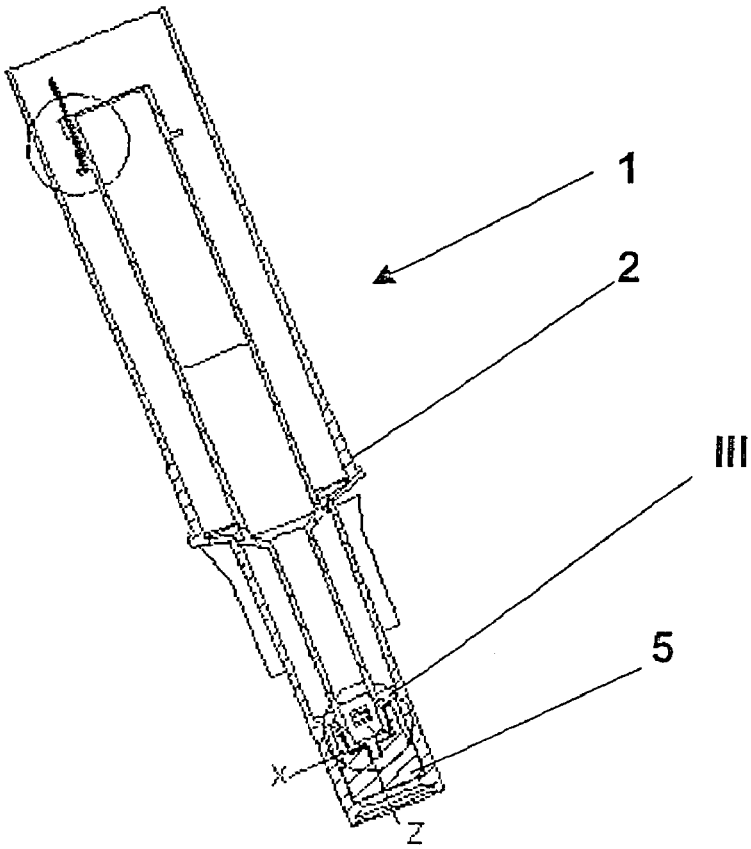
FIG. 2 shows a sectional view through the ignition coil according to FIG. 1.

FIG. 2 shows a sectional view of ignition coil 1 represented in FIG. 1, the areas shown relating to essential features of the invention represented in more detail in the subsequent figures.

Figure 3:
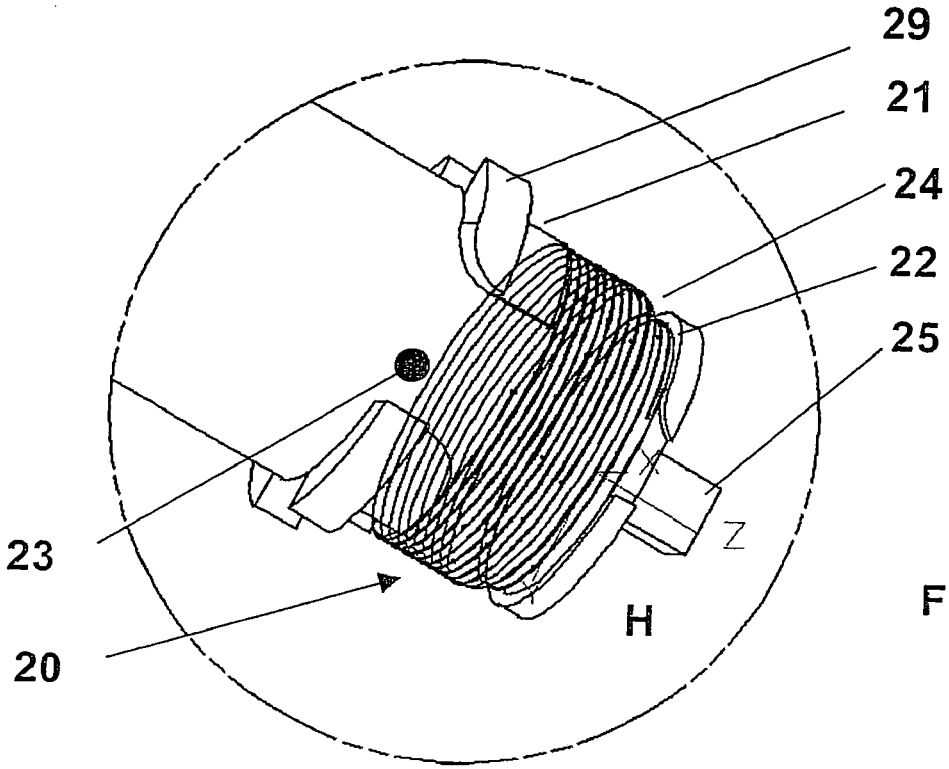
FIG. 3 shows an enlarged representation of the perspective view of the side of the high-voltage outlet of the ignition coil rod.

On high-voltage side H, a contacting area 20 (FIG. 3) is provided on ignition coil rod 3, which provides for the installation of a secondary winding 22 on a coil shell 21. Following the completion of the winding of secondary wire 22, it is guided through a bore hole 23 into contacting area 20, where it is further wound until it enters a groove 24 and reaches a pin 25. At pin 25, the free end of secondary wire 22 is tied up.

A contact sleeve 26 depicted in FIGS. 4 through 7 is now put over contacting area 20. This contact sleeve 26 has at least one axial slit 27, which, for example, does not extend over the entire length. In addition, provided on the peripheral surface of contact sleeve 26 is at least one contact clip 28 for establishing a contact with secondary winding 22 in contacting area 20 on the side of high-voltage outlet H.

By virtue of axial slit 27, contact sleeve 26 is now guided over contacting area 20 of ignition coil rod 3 on the side of high-voltage outlet H until it reaches a stop 29. The expansion of contact sleeve 26 while sliding it on prevents secondary winding 22 on the side of high-voltage outlet H from being damaged. Contact sleeve 26 is configured so that it reaches a press fit immediately after it has been slid over the contacting area, preventing contact sleeve 26 from falling off again.

Figure 4:
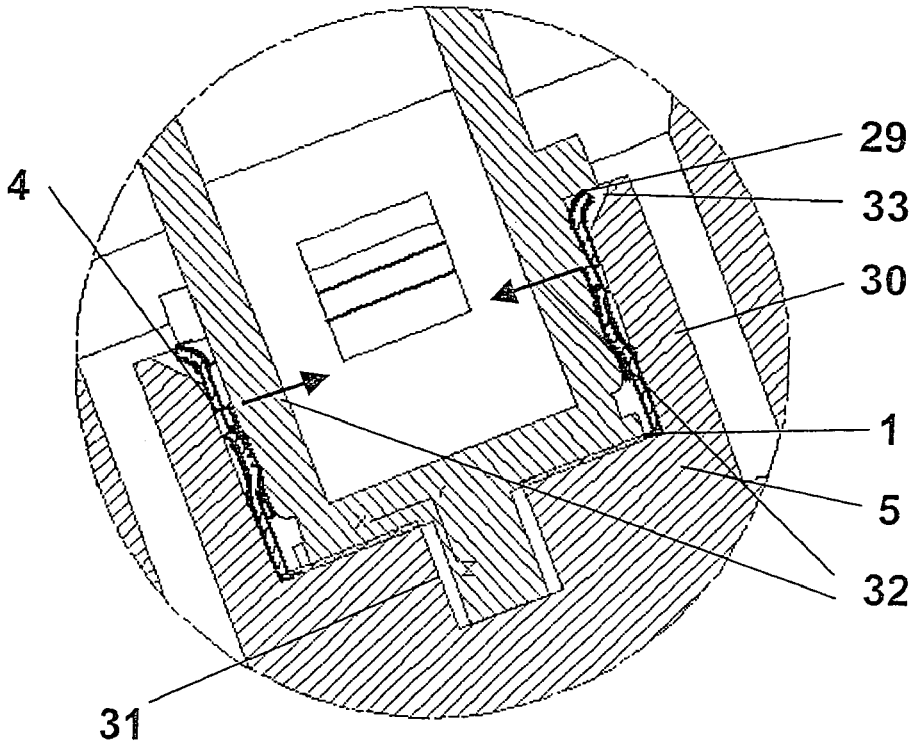
FIG. 4 shows a section through the enlarged view of the side of the high-voltage outlet according to FIG. 3.
Figure 5:
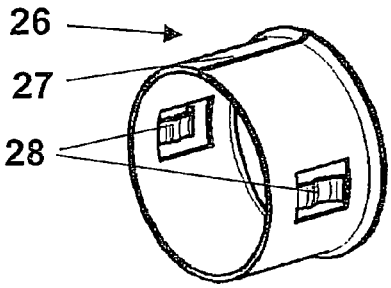
FIG. 5 shows a perspective view of the contact sleeve for installation on the side of the high-voltage outlet.
Figure 6:
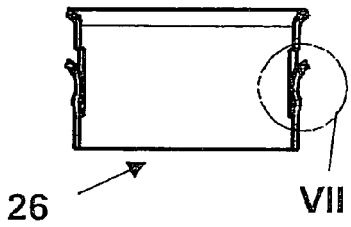
FIG. 6 shows a sectional view of the contact sleeve according to FIG. 5.
Figure 7:
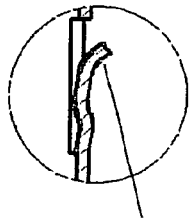
FIG. 7 shows an enlarged partial representation of the contact clips of the contact sleeve according to an example embodiment of the present invention according to FIG. 6.

As shown in FIG. 4, this assembly made up of ignition coil rod 3 and contact sleeve 26 is now installed into high-voltage outlet H of ignition coil housing 2. Ignition coil housing 2 features a cup-shaped formation 30 for receiving the free end of ignition coil rod 3. In addition, a recess 31 is provided for receiving pin 25 of ignition coil rod 3.

Due to cup-shaped formation 30 of ignition coil housing 2, contact clips 28 of contact sleeve 26 are pressed in a defined manner in the direction of an arrow 32 (FIG. 4). The insulating layer of secondary wire 22 is thereby pierced and an electrical contact permanently established. The free end of secondary wire 22, which is wound around pin 25, is inserted into recess 31. At the same time, stop 29, located on the side of ignition coil rod 3, rests on a shoulder 33 on the side of ignition coil housing 2. By integrating the contacting option and existing components, contacting options may be created between components and the secondary winding in an ignition coil via simple joining operations, while saving additional installation costs, assembly steps and the like.

What is claimed is:

1. An electrical connection arrangement for an ignition coil, comprising:

a coil shell having a secondary winding including at least one contacting area;

a contact sleeve at least partially slit lengthwise and configured to be placed over the at least one contacting area, the contact sleeve having an inner side configured to cooperate with the coil shell, and the contact sleeve having at least one contact clip with contacting elements on a side facing the coil shell; and a cup-shaped formation of the ignition coil configured to receive the contact sleeve;

wherein the contacting elements are configured to break through an insulting layer surrounding the secondary winding during the installation of the contact sleeve in the cup-shaped formation to achieve contact with the secondary winding.

2. The electrical connection arrangement of claim 1, wherein the ignition coil is a rod-type ignition coil including an ignition coil rod having a high-voltage outlet and a low-voltage outlet, and the contact sleeve is configured on a high-voltage outlet side of the ignition coil.

3. The electrical connection arrangement of claim 2, wherein the contact sleeve is installed in a press fit over the at least one contacting area.

4. The electrical connection arrangement of claim 3, wherein the contact sleeve is configured to be opened up as a spring.

5. The electrical connection arrangement of claim 3, wherein, in an installed state in an ignition coil housing and by cooperation with the ignition coil housing, the at least one contact clip is configured to lie against the at least one contacting area and establish an electrical connection.

6. The electrical connection arrangement of claim 3, wherein the high-voltage outlet includes an end having a pin configured to engage in a recess on a side of an ignition coil housing of the ignition coil in an installed state.

7. The electrical connection arrangement of claim 6, wherein the pin is provided for winding up one end of the secondary winding.

8. The electrical connection of claim 6, wherein the pin includes at least one rupture joint.

* * * * *